US009310132B1

(12) United States Patent
Gaur et al.

(10) Patent No.: US 9,310,132 B1
(45) Date of Patent: Apr. 12, 2016

(54) REPLACEABLE INSULATION ROOF FOR INDUSTRIAL OVEN

(71) Applicant: Carbonyx, Inc., Plano, TX (US)

(72) Inventors: Siddhartha Gaur, Plano, TX (US); Vibha Bansal, Plano, TX (US); Hasmukh Patel, Plano, TX (US); Albert Montgomery, Houston, TX (US); Pablo Palomo, Allen, TX (US); Samir Patel, Memphis, TN (US); Travis Day, Ardmore, OK (US)

(73) Assignee: Carbonyx, Inc., Plano, TX (US)

( * ) Notice: Subject to any disclaimer, the term of this patent is extended or adjusted under 35 U.S.C. 154(b) by 330 days.

(21) Appl. No.: 13/763,342

(22) Filed: Feb. 8, 2013

Related U.S. Application Data

(60) Provisional application No. 61/596,318, filed on Feb. 8, 2012.

(51) Int. Cl.
*F27B 3/16* (2006.01)
*F27D 1/02* (2006.01)
*F27D 1/16* (2006.01)

(52) U.S. Cl.
CPC ..... *F27D 1/022* (2013.01); *F27D 1/024* (2013.01); *F27D 1/16* (2013.01)

(58) Field of Classification Search
CPC ..... F23M 5/06; F27B 3/16
USPC ..... 432/238, 250; 266/283; 110/331, 332; 269/910
See application file for complete search history.

(56) References Cited

U.S. PATENT DOCUMENTS

| | | | | | |
|---|---|---|---|---|---|
| 3,716,222 | A | * | 2/1973 | Anderson | 432/133 |
| 3,778,221 | A | | 12/1973 | Bloom | |
| 3,778,950 | A | * | 12/1973 | Philander | 52/475.1 |
| 3,819,468 | A | * | 6/1974 | Sauder et al. | 428/99 |
| 3,971,639 | A | | 7/1976 | Matthews | |
| 4,066,740 | A | | 1/1978 | Erickson | |
| 4,081,236 | A | * | 3/1978 | Corbett | 432/3 |
| 4,128,394 | A | | 12/1978 | Naito et al. | |
| 4,192,645 | A | | 3/1980 | Hassler | |
| 4,287,024 | A | | 9/1981 | Thompson | |
| 4,294,878 | A | | 10/1981 | Cunningham et al. | |
| 4,298,341 | A | | 11/1981 | Nowack | |
| 4,329,142 | A | | 5/1982 | Dyer | |
| 4,421,481 | A | | 12/1983 | Holz et al. | |
| 4,488,027 | A | | 12/1984 | Dudley et al. | |
| 4,504,957 | A | * | 3/1985 | McClelland et al. | 373/130 |
| 4,638,492 | A | * | 1/1987 | Kerr | 373/74 |
| 4,653,732 | A | | 3/1987 | Wunning et al. | |
| 4,674,975 | A | | 6/1987 | Corato et al. | |
| 4,721,461 | A | * | 1/1988 | Falk | 432/247 |
| 4,831,238 | A | | 5/1989 | Smith et al. | |
| 4,873,107 | A | | 10/1989 | Archer | |
| 4,965,435 | A | | 10/1990 | Smith et al. | |
| 5,090,651 | A | | 2/1992 | Mittag | |
| 5,114,542 | A | | 5/1992 | Childress et al. | |
| 5,287,383 | A | | 2/1994 | Hirai | |
| 5,678,496 | A | | 10/1997 | Buizza et al. | |
| 5,725,738 | A | | 3/1998 | Brioni et al. | |
| 5,906,485 | A | | 5/1999 | Groff et al. | |
| 6,015,288 | A | | 1/2000 | Mundon | |

(Continued)

*Primary Examiner* — Gregory A Wilson
(74) *Attorney, Agent, or Firm* — Osha Liang LLP; John W. Montgomery

(57) ABSTRACT

A device and a method are disclosed for replaceably insulating a roof of an industrial oven that allows repair of damaged insulation while the oven continues operation at high temperatures.

8 Claims, 12 Drawing Sheets

(56) References Cited

U.S. PATENT DOCUMENTS

| | | | | |
|---|---|---|---|---|
| 6,089,860 | A | 7/2000 | Dull et al. | |
| 6,283,748 | B1 | 9/2001 | Orbeck et al. | |
| 6,383,449 | B1 | 5/2002 | Pennekamp et al. | |
| 6,422,862 | B1 * | 7/2002 | Arechavaleta-Villarreal | 432/248 |
| 6,427,610 | B1 * | 8/2002 | Coates et al. | 110/339 |
| 6,572,369 | B2 | 6/2003 | Linke | |
| 6,773,256 | B2 | 8/2004 | Joshi et al. | |
| 7,150,627 | B2 | 12/2006 | Gaur et al. | |
| 8,693,518 | B2 * | 4/2014 | Lindeman et al. | 373/73 |
| 2005/0204699 | A1 * | 9/2005 | Rue | 52/794.1 |
| 2010/0281784 | A1 * | 11/2010 | Leo | 52/16 |

* cited by examiner

REPLACEABLE INSULATION ROOF FOR INDUSTRIAL OVEN

RELATED APPLICATION

The present application claims priority to U.S. Provisional Application Ser. No. 61/596,318, filed Feb. 8, 2012, which is incorporated herein by reference and relied upon for priority and all legitimate purposes.

BACKGROUND OF INVENTION

1. Field of the Invention

This invention relates generally to insulation of a roof for an industrial oven.

2. Background Art

Industrial ovens often operate at temperatures near or above the melting point of most metal; for example, coking ovens can operate at temperatures approaching 1300° C. (about 2400° F.). Even when the product is required to be heated to temperatures below the melting point of the metal structure, metal becomes weak and subject to increased oxidation at elevated temperatures. Industrial ovens, such as industrial tunnel ovens, require insulation to efficiently retain heat within the oven and to prevent heat related damage to structural elements of the oven and to surrounding facility structure, equipment and personnel. In some prior industrial ovens the insulation has been provided with structural refractory brick. Refractory brick is expensive and difficult to support when constructing roofs and particularly for large area roofs such as those found in industrial tunnel ovens.

In recent years the insulation has been provided in some industrial ovens with lightweight, high temperature insulation materials such as fiberglass batting, ceramic fiber mat, or ceramic fiber blanket materials. Such lightweight materials in sheet form are sufficiently light to be supported from a roof; however, such materials do not generally have sufficient mechanical strength against sagging when extended across large areas. The typical oven has a metal roof, sometimes made of high temperature heat resistant steel. The highest temperature metal materials available at a reasonable cost for large scale construction are not capable of withstanding the internal oven temperature. Sheets of the fibrous insulating material are generally mounted to the high temperature metal sheet material that covers and forms the roof of the industrial oven. A continuous coverage layer is formed of abutting adjacent sheets or tiles and/or overlapping fibrous sheets or tiles. Close spacing is required because any gaps between the sheets could expose the underlying support metal to the high heat of the oven. Thus, sheets of fibrous insulation material that are supported from a flat metal structure can provide a cost effective and simplified oven roof construction compared to the use of refractory brick insulation.

Periodically, through contact, over heating, and/or repeated heat exposure, portions of the fibrous insulation material may become damaged causing exposure of the metal sheet materials supporting the insulation. Continued operation can result in melting of the supporting metal structure and/or complete burn-out of portions of the oven roof. Unfortunately, permanent repairs to damaged portions of the lightweight fibrous insulation material cannot currently be accomplished without shutting down the oven and entering into the oven to provide replacement insulation from within the oven. Discontinuing operation to repair the damage can result in significant product losses, plant downtime and wasted heat energy costs of reheating the oven after it is cooled and repaired. Temporary repairs such as plugging the burned out portion from outside of the oven might keep the operation going; however, such patchwork repair cannot generally prevent continued and increased damage because of the internal exposure of the support structure to the high heat within the oven. Repairs requiring oven shut down can cause costly waste of heat energy, product losses, and costly down time due to interruptions in continuous heat processing of the types typically accomplished using industrial tunnel ovens.

SUMMARY OF INVENTION

According to one or more embodiments, the invention provides a device and method for insulating an industrial oven that allows repair or replacement of roof insulation for the industrial oven while the oven continues operation at high temperatures.

According to one or more embodiments, the invention provides a method of insulating a roof of an industrial oven and for removal and replacement of roof insulation while the oven continues to operate at high temperatures.

Other aspects and advantages of the invention will be apparent from the following description, drawings, and the appended claims.

DETAILED DESCRIPTION

Figure 1:
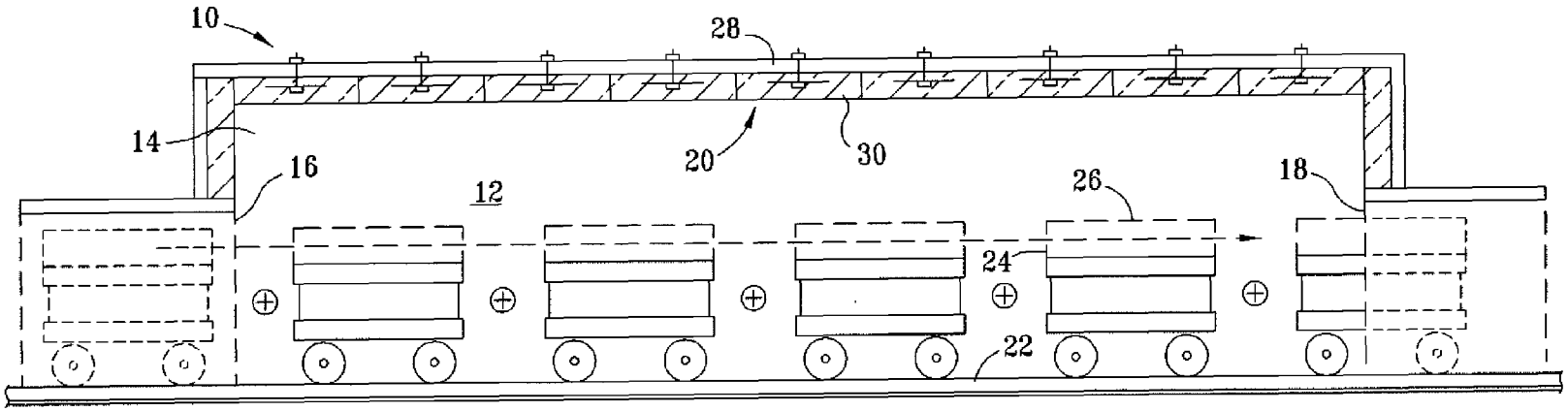
FIG. 1 (PRIOR ART)
FIG. 1 is a schematic representation of a prior art industrial oven.

To understand the discovery of problems and the inventive solutions provided by the inventors, a schematic representation of a prior art industrial oven 10 is depicted in FIG. 1 as a section side view taken along a center line extending along the center of a heated passage 12 of the oven 10. In this example, a tunnel oven 10 is shown and the passage is formed between two opposed sides 14 and an opposite parallel side 15 (not shown). There is an entrance end 16 through which products to be heated are received. The products are heated as they move toward the exit end 18. The passage 12 is closed from above by a roof 20 and from below by a floor 22. A moveable transport vehicle 24 carries the product as it is transported from the entrance 16 through the heated passage 12 and then out the exit end 18. The heating in the oven may be accomplished by burning of fuel, such as gaseous or powered hydrocarbons, by electrical resistance elements, or otherwise by convection, radiation or conduction. The heat is retained in the oven by insulation at the side and end walls and also by a plurality of insulating mats 30 supported edge to edge and attached to a roof support 28 made of sheets of metal extending from and supported by the opposed insulated side walls and the insulated entrance and end walls. A continuous insulated roof is formed by closely abutting or overlapping a plurality of adjacent insulating mats 30.

Figure 2:
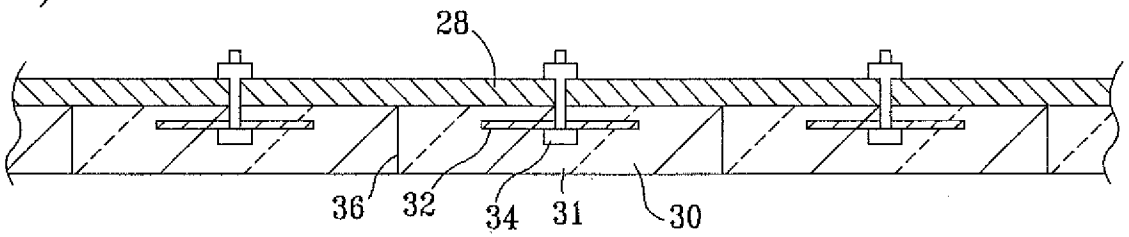
FIG. 2 (PRIOR ART)
FIG. 2 is a partial cross section of one type of prior art roof insulation for an industrial oven.

One type of prior art roof insulation mat 30 that has been used for an industrial oven 10 is depicted in a partial cut-away section view in FIG. 2. The insulating mats 30 are formed with an internal metal attachment plate 32 with a fasten 34, such as a threaded stud and nut, a bolt and nut, or a screw that may be secured from below into the metal support roof. A portion 31 of the insulation material of one of the insulating mats 30 covers the attachment plate 32 and the fastener 34 so that these metal parts are not exposed to direct heat from the oven passage 12 below. The insulating mats 30 are attached abutted edge to edge or overlapping at the edges so that no part of the metal roof support is exposed to direct heat from the oven below.

Figure 3:
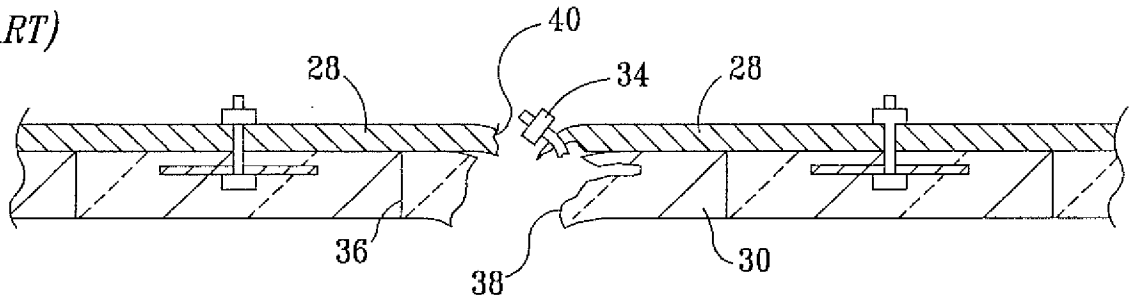
FIG. 3 (PRIOR ART)
FIG. 3 is a partial cross section of a hypothetically damaged prior art roof insulation for an industrial oven.

A hypothetically damaged prior art roof insulation for an industrial oven is depicted in FIG. 3. In this case the damaged insulation at the portion 31 has resulted in direct heat exposure to the internal plate 32 and the fastener 34, both of which have been melted away and also direct heat exposure to an area 40 of the metal support roof that has sagged and partially melted. At this point in operation of the oven, hot gases are escaping through the roof and the damaged area. The damage may easily "spread" as the escaping hot gases directly heat the exposed metal roof and as the heat is conducted along the metal roof support. Because each of the insulating mats 30 is secured to the roof support 28 from below, a new insulating mat 30 cannot easily be inserted at the point of the damage without interrupting the operation of the oven. The heating must be discontinued, the oven must be cooled, the partially processed product must be removed and/or adequately cooled and the oven passage 12 must be entered after it is cooled sufficiently, to repair the damaged area and to replace any of the insulating mats 30.

Figure 4:
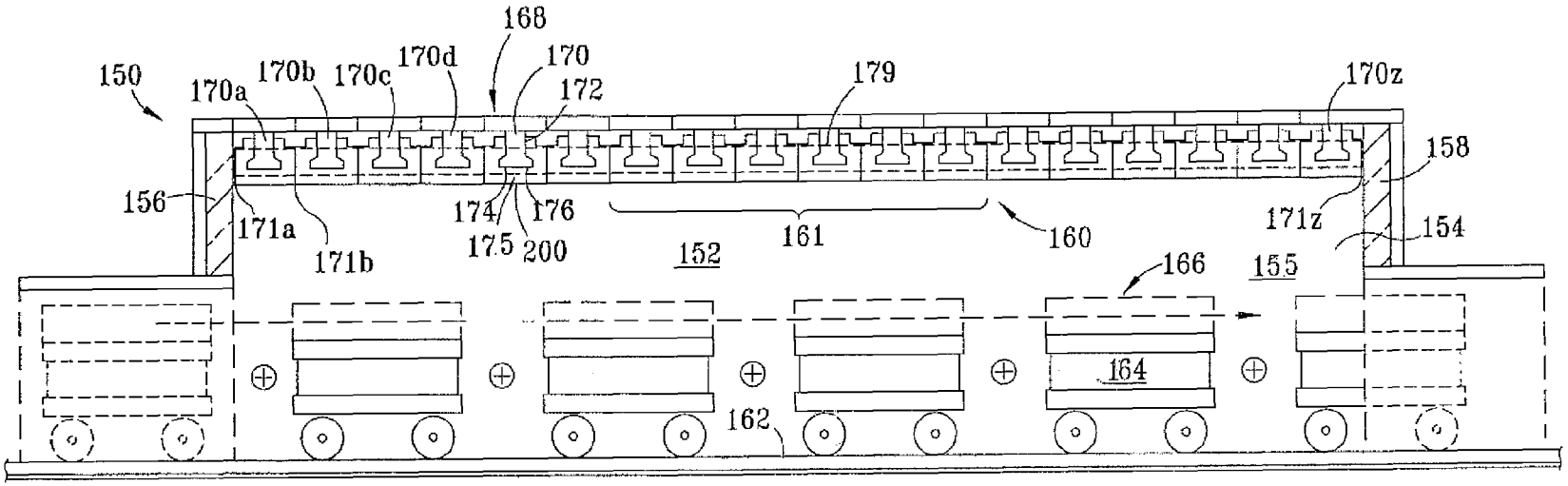
FIG. 4 is a side section view taken along an imaginary center line of an industrial tunnel oven and schematically depicting one embodiment of a replaceable insulation roof construction according to the invention.
Figure 5:
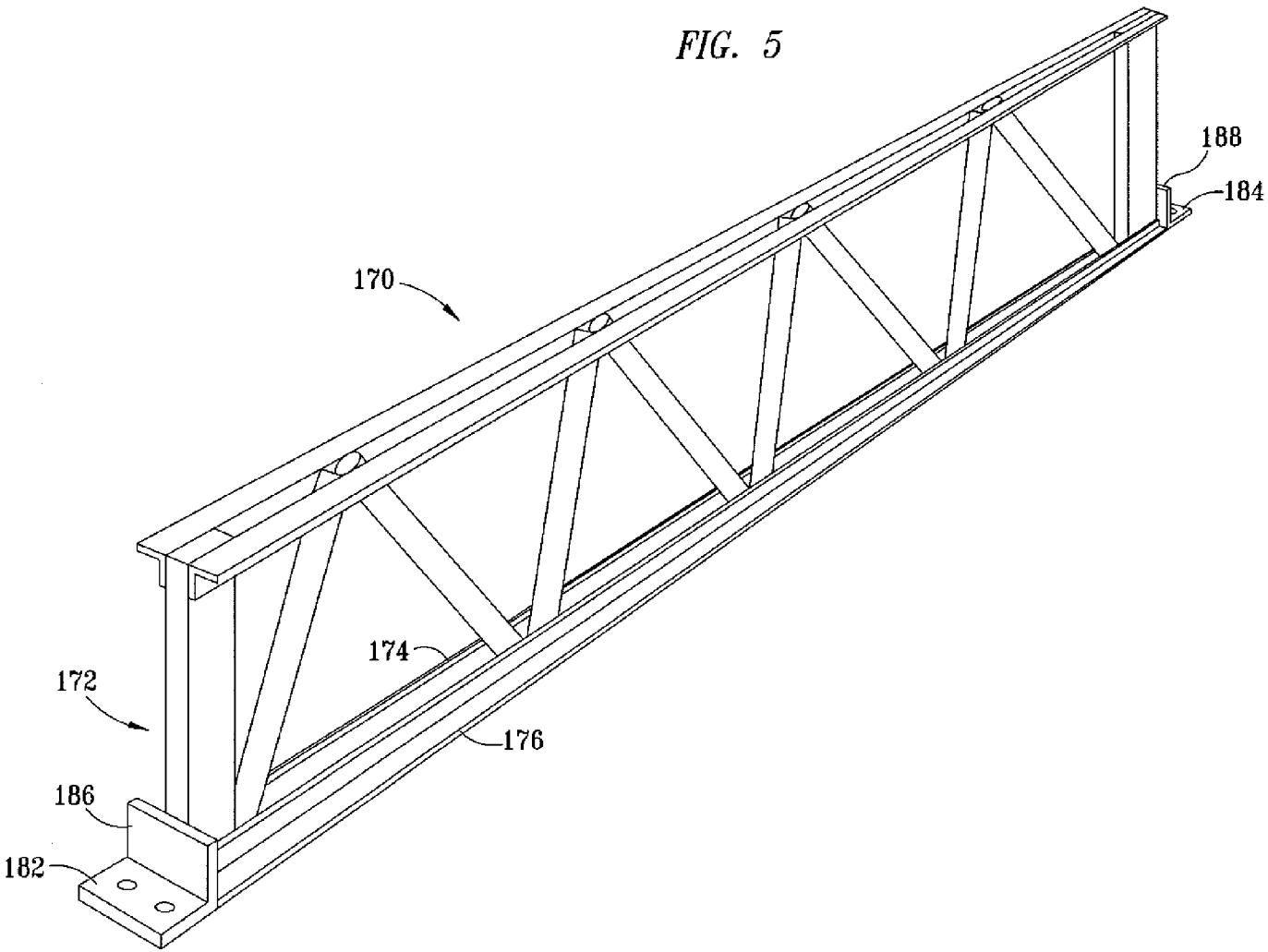
FIG. 5 is a perspective view of one embodiment of a truss for construction of a replaceable insulation roof according to the invention.
Figure 6:
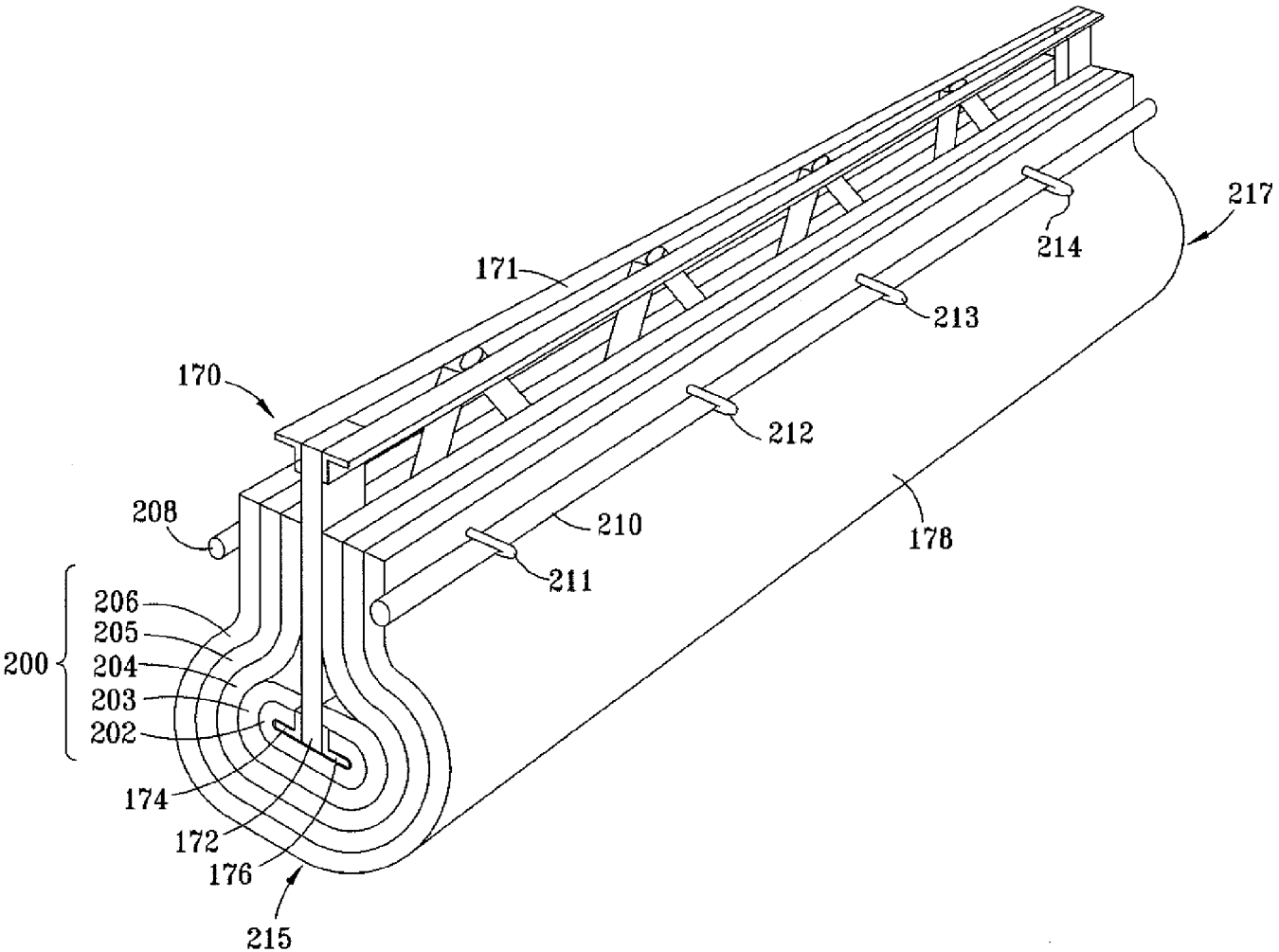
FIG. 6 is a perspective view of one embodiment of a truss wrapped with insulating material to form a replaceable insulation roof truss according to the invention.

According to one or more embodiments, as may be understood with reference to FIGS. 4-6, an insulated roof 160 is provided for an industrial tunnel oven 150 of the type of industrial oven having parallel side walls that are spaced apart from each other and that extend along the length of the tunnel oven. The insulated roof comprises a plurality of transverse trusses that are made of metal. Lower portions of the trusses are wrapped with fibrous insulating material having a sufficiently high melting point to withstand the oven operating temperature and having sufficient thermal resistance to prevent heat related damage to the metal truss structure on which the fibrous insulating material is wrapped. The insulation wrapped roof trusses are held together in parallel alignment relative to adjacent insulation wrapped roof trusses so that the fibrous insulating material wrapped on the aligned adjacent trusses will be in contact and partially compressed together to provide a heat sealed juncture therebetween.

One embodiment of the invention, as schematically depicted in FIG. 4, provides an improved industrial oven 150 with a replaceable insulated roof 160. The industrial oven 150 is depicted in this embodiment as a tunnel oven, also known as a tunnel kiln, and those skilled in the art will appreciate the particular usefulness of aspects of the invention for tunnel kilns and will also appreciate that certain aspects may also be useful for other types of industrial ovens. A side section view is shown in FIG. 4 that is taken along an imaginary center line of an industrial tunnel oven 150. The industrial oven 150 includes a heated passage 152, insulated sides, including side 154 and an opposed side 155 (represented with the outlined and underlined reference numeral 155 as the opposed side wall to side wall 154 in the cross-section view in FIG. 4), an insulated entrance end wall 156 and an opposite insulated exit end wall 158. For example, an insulated entrance end wall 156 and an insulated exit end wall 158. A replaceable insulation roof 160 is shown constructed according to one embodiment of the invention. The replaceable insulation roof 160 extends substantially continuously over portions of the oven passage 152 and spaced above the oven floor 162. It will be understood that substantially continuously is intended to mean that the extended insulated portion of the insulated roof is heat sealed without major unintended heat escape although it may be interrupted by chimneys, vents, sprayers, injectors, burners and/or other structures of the type used to exhaust gasses, control the composition of the oven atmosphere, and/or to control the temperature within the oven. A transport means 164 is depicted for carrying products 166 or other materials to be heated along and through the oven passage 152. For one example, the transport means 164 may comprise a plurality of products carrying rolling carts 164 that may be sequentially moved through the oven passage 152 so that the products 166 to be heated in the oven can be heated in the oven according to a predetermined temperature and/or heating profile. The replaceable insulation roof 160 is formed of a plurality of trusses 170, shown as trusses 170*a, b, c, d*, and z, etc. It will be understood that the number of trusses 170 is not limited by the embodiment depicted and will depend upon the size of the trusses 170 and the size and total length of portions of the industrial oven 150 to be provided with a continuous insulated roof.

According to one embodiment, the trusses 170 may be constructed with a vertical bridge portion 172 extending transversely across from one side 154 to the other side 155 (represented with the outlined and underlined reference numeral 155 as the opposed side wall to side wall 154 in the cross-section view in FIG. 4). The vertical bridge 172 supports at least one horizontally disposed lower portion 175. In one embodiment the lower portion 175 may comprise oppositely directed lips 174 and 176 and lips 174 and 176 may be fastened to or integrally formed along a lower part of the bridge 172. The lower portion 175 or the lips 174 and 176 are wrapped with fibrous insulation material 178 such as fiberglass, mineral fiber, or fibrous ceramic depending upon the operating temperatures of the industrial oven 150. In one or more embodiments the insulation material 178 may be in the form of sheets, mats or blankets that may be available from insulation manufacturers having predetermined insulation characteristics. For example, fiberglass sheets may withstand temperatures of 450° F. up to about 1000° F., mineral wool and calcium silicate mats may withstand up to about 1200° F., and ceramic fiber blankets may withstand 2300° F. up to about 3200° F. Those skilled in the art will understand from this description that sheets, mats, or blankets of insulation material may have thicknesses of a fraction of an inch up to several inches and the sizes may include length and width dimensions of many feet to provide a large total area for a sheet of insulation 178 that may be cut to size to be wrapped around the trusses. Several sheets may be used abutted side-by-side in a layer to span from one side of the truss to another side of the truss. In the case of a layer of wrapped insulation formed of side-by-side abutted sheets, a next layer may overlap the abutted seams with a continuous piece of insulation (i.e., alternating seams for the different layers) to maintain heat sealed insulation across the trusses.

In one or more embodiments a plurality of insulation wrapped trusses are replaceably held together in parallel alignment with other adjacent insulation wrapped trusses, for example truss 170*a* may be held together adjacent to truss 170*b*, so that the fibrous insulating materials that are wrapped on the lower portions of adjacent trusses are in parallel contact and the insulating material is partially compressed together along an area of contact to provide a heat sealed juncture 171*b* therebetween. A heat seal 171*a* may also be formed between the end wall 156 and the truss 170*a* and also a heat seal may be formed at 171*z* between insulated truss 170*z* and the other end wall 158.

A perspective view of one example of a truss 170 for construction of a replaceable insulation roof 160, according to one or more embodiments of the invention is depicted in FIG. 5. The truss 170 includes a vertical bridge 172 that may be constructed as one or more substantially continuous metal plates, it may be constructed as a plate with cutout sections, it may be constructed as depicted in FIG. 5 with a plurality of beams and cross members fastened together, or otherwise so that support spanning across from one side wall 154 to another side wall 155 of the industrial oven 150 is provided. A lower portion 175 (that may include a lip portion 176) extends at least partially in a horizontal orientation relative to a vertical bridge portion 172. The lip 176 is attached to or integrally formed along the vertical support bridge 172. Another lip portion 174 is attached or formed extending at least partially in a horizontal direction opposite from the lip 176. Fastener plates 182 and 184 may be secured to opposite ends 186 and 188 of the truss 170. Ends 186 and 188 may include a reinforcing structure attached to further secure the lower portion 175 to the vertical bridge 172, such as horizontal lips 174 and 176 attached to the vertical bridge 172, and/or to facilitate securing the vertical bridge 172 to the oven side walls 154 and 156.

In one or more embodiments the width from the inside of one side wall 154 of the industrial oven 150 to the other side wall 156 is smaller than the width of the wrapped insulation material 178 on the truss 170 so that the side portions 177 and 179 of the wrapped insulation material 178 will be compressed against the insides of the side walls 154 and 156 respectively, and to thereby form a heat seal at the juncture of the insulated roof 160 and the oven side walls.

According to one embodiment as shown in FIG. 6, the fibrous insulating material 178 wrapped around the lower lips 174 and 176 may comprise a layered wrapping 200 of the fibrous insulating material comprising a plurality of layers, for example, layers depicted as interior layers 202 and 203, intermediate layers 204 and 205, and exterior layer 206. The layers may be wrapped around each of the lower lips 174 and 176 of trusses 170 and upward toward the top of truss 170 and secured to the vertical bridge member 172. The layers of the fibrous insulating material may be secured to the trusses by clamping or other fastening means that secures the layers upward against the lower portion of the trusses and tightly together against each other layer. One example of construction for clamping the layers to the truss 170 includes clamp bars 208 and 210 secured to the bridge 172 with fasteners such as U-bolts 211-214. The number of layers of fibrous insulation material 178 may be greater or smaller than the number depicted. According to one or more aspects of the invention, the number of layers of insulation material 178 may be predetermined based upon the intended operation temperatures and cycle times, the thickness of each layer, the heat resistance of the insulation material, and the total minimum thickness of the wrapped insulation material 178, so that the metal truss lips 174, 176 and bridge 172 do not become overheated due to heat transfer from the oven.

According to one useful embodiment, the fibrous insulation material 178 wrapped around the lower portion 175 of the truss 170 may comprise insulating material having varied or different insulating characteristics from the exterior to the interior of the insulating material, such as varied or different maximum temperature rating and varied or different heat transfer resistance at the oven exposed surface compared to the interior of insulation material or compared to the surface adjacent to the metal truss. This can be useful, for example, to reduce cost of materials in situations where fibrous insulation material having a higher maximum temperature rating is typically more expensive than lower temperature rated material and the high temperature material is used at the exterior surface and the lower temperature rated material is used at the interior surface against the metal truss lips 174 and 176. In one or more embodiments this useful feature may be obtained with a construction using layered wrapping 200 of the fibrous insulation material 178 comprising a plurality of layers, for example layers depicted as interior layers 202 and 203, intermediate layers 204 and 205, and exterior layer 206. The layers may be wrapped around each of the lower lips 174 and 176 of truss 170 and upward onto the vertical bridge member 172. In one embodiment this usefulness can be obtained by providing high temperature rated material for an exterior layer 206, or at the exterior layer 206 and one or more adjacent intermediate layers 205. For example, fiberglass sheets may withstand temperatures of 450° F. up to about 1000° F., mineral wool and calcium silicate may withstand up to about 1200° F., and ceramic fiber blankets may withstand 2300° F. up to about 3200° F. Typically the temperature rating of insulating material means that the melting point of the ceramic material is above the rated temperature.

In one example of an embodiment, the exterior layer 206 may be made of ceramic blanket material at the higher end of range above the maximum temperature of the oven and up to about 3200° F. The exterior layer may also be selected for enhanced mechanical characteristics such as abrasion resistance. The intermediate layers 205 and/or 204 may be composed of fibrous insulating material rated for temperatures lower than the exposed exterior layer 206, such as an intermediate temperature in a range of below the maximum temperature of the oven, 2300° F. Because higher temperature rated insulation material is more expensive than lower temperature rated insulation material, significant cost savings can be obtained according to an embodiment with the high temperature material on the exterior exposed to the oven temperature and lower temperature rated materials at the interior of the wrapping and lower temperature material at the interior surface against the metal truss. The interior layers 202 and/or

203 may be rated at lower temperatures up to about 2300° F. The mechanical characteristics of the exterior layers, the intermediate layers and the interior layers may also affect the cost of the material and may be usefully selected to provide durability and structural integrity.

According to one of more embodiments, and because insulation layer construction is used, the combinations of characteristics may be predetermined according to the intended operation of the oven. In one embodiment one or more exterior layers may be at the same high temperature and the intermediate and interior layers may be at the same lower temperature. Although examples of specific useful arrangements of layers have been described, it will be understood upon reading this description that other combinations of layers and characteristics may be usefully obtained according to embodiments of the invention based upon the fibrous material layered construction.

According to one or more embodiments, for example, when the insulation on a roof truss is damaged, when an insulated roof truss is to be replaced with different insulation capabilities, or when an insulated roof truss is to be upgraded for higher temperature operation, the existing insulated roof truss can be disconnected from the side walls of the oven, removed from the oven (for example, by lifting with a crane or hoist not shown), and replaced with another insulated roof truss (for example, replaced from above with a crane or hoist). Usefully according to one or more embodiments of the invention, the insulated roof truss may be removed and replaced while the oven continues to operate. While some of the heat from the industrial oven might escape for a short period during the removal and replacement, this can be done with heat shielded equipment, such as cranes or hoists that might be operated quickly and sequentially to minimize the heat loss. Advantageously, the industrial oven may continue operation, with the temperature maintained at least in the oven passage that is below other insulated roof trusses that are not being removed and replaced. Thus, the entire oven need not be shut down and cooled to allow entry into the oven for repair, replacement, or upgrading of the roof insulation. In some instances the burners in the oven that are positioned below the insulated roof truss to be replaced and/or below adjacent insulated roof trusses of the oven roof can be temporarily adjusted to reduce the heat loss during roof truss replacement. For example, the burning rate may be reduced before and during the removal and replacement of the insulation wrapped roof truss. The burner operation may also be adjusted to replace heat or to compensate for any heat loss that might occur during removal and replacement of the roof truss. For example, the burning rate may be temporarily increased after the installation is completed.

According to one or more embodiments the total thickness of the multiple layers 200 of insulation material 178 is sufficient so that portions of exterior surfaces 207 of the exterior layers 206 of adjacent insulated roof trusses are compressed together when the insulated trusses are installed, thereby partially compressing or flattening the adjacent surfaces against each other at interfaces 171 to form a heat seal therebetween. In the case of forming a new insulated roof 160 a first insulated truss 170*a* may be placed across the tops of the side walls of the oven and pushed against the entrance end wall 156 before securing it in place thereby compressing one portion of exterior surface 207*a* to form a heat seal 171*a* against the end wall 156. A next insulated truss 170*b* may be placed adjacent to the first insulated truss 170*a* and pushed against the first truss 170*a* to compress portions of both the exterior surfaces 207*a* and 207*b* against each other to from a heat seal 171*b* therebetween. The process may be continued for the length of the oven, with each insulated truss compressed against the next until the opposite end wall 158 is reached. The end truss, for example truss 170*z*, may be pushed against the end wall 158 and moved down into position spanning across the oven at the top of the oven side walls to form a heat seal 171*z*+1 at the end wall 158. The compressed insulation material is allowed to partially "spring" back against the adjacent insulated truss 170*y* thereby forming heat seal 171*z* and for all the trusses 170 a-z with portions of their surfaces 172*a-z* forming heart seals 171*a*-171*z*+1 at each interface between adjacent trusses and at the trusses against the opposite end walls.

The width of the insulation layers 200 on each of the trusses 170 may also extend beyond each opposite side of support bridge 172 so that the insulation material 178 is wider than the distance between the oven side walls 154 and 155 and so that the fibrous insulation material 178 at the opposite sides 215 and 217 of each of the trusses 170 compresses against the interior surfaces of the side walls 154 and 155 of the industrial oven 150, thereby providing a heat seal all along the length of the oven channel 152 at the opposed sides 215 and 217 of the insulated roof 160 that is formed by the plurality of insulated trusses 170*a-z*. It has been found that when using fibrous ceramic blanket material the ceramic fibers have greater thermal resistance than air (and greater thermal resistance than some other gases that might be present in the oven) so that compression of the fibrous ceramic insulation material can usefully increase the heat resistance properties at the heat seals where the insulation material 178 is compressed according to one or more embodiments of the invention.

In one or more embodiments, it has been discovered by the inventors that when an insulated truss 170 is removed and replaced with another insulated truss170, the removal of one insulated truss, for example truss 170*c* might cause damage to an exterior layer of insulation material 206 of one or more adjacent trusses 170*b* and 170*d*. In a typical situation the damage is in the form of a gap caused by partial removal of the insulation material at the interface or seal surface, for example at heat seal 171*c* and/or heat seal 171*d*. In such instances and according to this example, a wider replacement insulated truss 170*c* may be used. A wider insulted truss may comprise an insulated truss with a wider lower truss lip, an insulated truss with more layers of insulation material, or one with thicker layers of insulation material, and the wider insulated truss may be used to fill the gap and to compress against the adjacent insulated trusses, for example against trusses 170*b* and 170*d* on either side of the replaced truss 170*c*, to form a heat seal between each truss.

It has also been found by the inventors that the adjacent layers of insulation material may have become vitrified, embrittled, or otherwise structurally weakened by previous heating of the oven such that pushing a replacement insulation truss into the place of a removed insulated truss may cause the adjacent surfaces to crumble, shear, fracture, or to otherwise be damaged. In one or more embodiments the replacement truss may have resilient (not vitrified) fibrous insulation so that it may be compressed by one or more mechanical compressing mechanism substantially along the entire width. The replacement truss can be inserted without additional scraping and the compressed insulation material can be released from mechanical compression thereby expanding and pressing outward in a direction normal to and against the adjacent insulation material of the adjacent truss, without scraping or shearing, and to thereby form a partially compressed heat seal interface therebetween. Compression of the insulation material for insertion of the truss may be particularly useful when the replacement truss is wider than the replaced truss.

Usefully, according to one or more embodiments of a method of replacing insulation of an industrial oven roof, the use of layers of fibrous insulation material permits increasing the thickness of an insulated truss by adding additional layers or additional sheets of fibrous insulation material. In the case of a preformed insulated truss, additional layers may be wrapped around the truss prior to replacement. In the case of existing trusses, additional layers of insulation material may be inserted between the insulated trusses and the oven walls, between the trusses and end wall of the oven, and between insulated trusses and other adjacent insulated trusses. Insertion of such added layers of insulation material can be effective to increase the amount of compression of the insulation materials or to make up thickness of the insulation material to fill any gaps such as might occur from compressed material, lost material, or any uneven spacing between trusses. In one embodiment the added insulation material may be provided by wrapping the truss with additional layers of insulation material. In another embodiment, the added material might be by insertion of additional sheets directly at the interface or the seal between adjacent trusses or between the trusses and the side walls of the oven or between the trusses and the end walls of the oven. For example, when one insulated truss is replaced with another the replacement truss may be constructed with a greater thickness of insulation material (thicker layers or a greater number of layers) to replace any loss of material due to damage, crumbling, scraping, shear, or adhesion of adjacent fibrous insulation materials on adjacent insulated trusses. Alternatively, a sheet may be inserted at the interface. In another example, the sides 215 and 217 of the fibrous insulation layers may also extend sufficiently beyond the metal truss structure, (i.e., wider than the inside of the spaced apart interior walls of the oven) so that the fibrous insulation material compresses against the walls to form heat sealed interfaces. Alternatively, a sheet may be inserted between the sides of the truss and the oven wall.

According to one or more embodiments, a temporary mechanical compression mechanism may be formed of a material that will burn-out, evaporate, or otherwise disintegrate upon heating by the oven so that placing a mechanically compressed insulated truss into the place of the removed truss is facilitated. After insertion of the replacement truss, the temporary compression mechanism is melted away, burned away, or evaporated during oven operation so that the temporary mechanical compression mechanism releases its compressive force on the insulation material and allows the new resilient insulation material to expand into any existing space and against the surfaces of adjacent trusses or against adjacent end walls to form a heat insulating seal. In some examples, the compression mechanism may be a wooden structure such as a large wooden clamp, a plastic sleeve, or multiple wrappings of duct tape or another industrial tape. In another example, the compression mechanism might be a clamp or wrapping device made of a relatively low melting temperature metal such as lead or aluminum for an oven operating at temperatures substantially higher than the melting temperature of the metal. The temporary compression mechanism should provide sufficient structural integrity to hold the insulation in compression on the insulated truss during insertion into an operating oven and then to burn, melt, evaporate or otherwise disintegrate and thereby release the compressive force so the insulation material expands outward and partially compressed against an adjacent surface to form a heat seal.

According to one or more embodiments, the plurality of trusses may be attached together, for example at 179, to form an insulated roof section 161. The trusses that are attached together in an insulated roof section 161 and supported at sides of the roof trusses from the opposed sidewalls of the oven so that the entire section 161 can be lifted, or otherwise removed, from the top of the oven and replaced with another insulated roof section. The removed insulated roof section may be repaired for subsequent replacement. According to one or more embodiments the sides of the replacement insulated roof section 161 may be made wider to be compressed into the space left by the removed insulated roof section 161. According to one or more embodiments the exterior edges of a new insulated roof section 161 may be compressed mechanically and then allowed to resiliently expand into the space of a removed insulated roof section 161 as described previously in this disclosure for a single replaced insulated truss 170.

According to one or more embodiments of an inventive method, for example, when an insulated roof section 161 is damaged, when an insulated roof section 161 is to be replaced with different insulation capabilities, or when an insulated roof section is to be upgraded for higher temperature operation, the existing insulated roof section can be disconnected from the side walls 154 and 155 of the oven, removed from the oven 150 (for example, by lifting with a crane or hoist, not shown), and replaced with another insulated roof section 161 (for example, replaced from above with a crane or hoist). Usefully, according to one or more embodiments of the invention, the insulated roof section 161 may be removed and replaced while the industrial oven 150 continues to operate. While some of the heat from the industrial oven 150 might escape for a short period during the removal and replacement of the insulated roof section 161, this can be done with heat shielded equipment. It might be understood that such heat shielded equipment might be cranes or hoists wrapped with high temperature rated insulation material and that might be operated quickly and sequentially to lift one insulated section and lower another replacement insulated roof section into place to minimize the heat loss from the oven and heat transfer to the equipment. Usefully, the industrial oven may continue operation, with the heated products maintained at a high temperature in the oven passage 152. While some heat might escape at the exact location of the insulated roof section being replaced, the temperature may be maintained at least in parts of the oven passage 152 that are not immediately below or immediately adjacent to the roof section that is being removed and replaced. Thus, the entire oven need not be shut down, cooled, and product removed to allow entry into the oven for repair, replacement, or upgrading. In some instances according to one or more embodiments of the inventive method, the burners in the oven below the roof section to be replaced and/or below adjacent sections of roof can be temporarily adjusted to reduce the heat loss during roof section lifting and/or to compensate for the heat loss during removal and quickly when the replacement roof section is installed.

In one or more embodiments, as may be understood with reference to FIGS. 7-10, the metal structures or support bridges, for example 272*a* and 272*b* of two or more of the roof trusses 270*a* and 270*b* are attached together parallel to each other. The lower portions maybe uniformly spaced apart and fibrous insulation material 278 is wrapped around the lower portions of the two or more metal truss structures 270*a* and 270*b*. In one embodiment two adjacent trusses are attached together in an adjacent parallel configuration to form a connected pair of roof trusses 290. The fibrous insulation material 178 may be secured to and wrapped around one of the two adjacent trusses 270*a*, stretched across a horizontal space 273 between the lower portions of the connected pair of trusses 290, wrapped around the lower portion of the other adjacent truss 270*b*, and secured to the other adjacent truss to form the insulation wrapped connected pair of trusses 290. In one or more embodiments a plurality of connected pairs of insulation wrapped trusses 290*a-z* are held together in a parallel alignment with each other adjacent insulation wrapped connected pairs of trusses. The fibrous insulating materials wrapped on the lower portions of adjacent connected pairs of trusses are in parallel contact and partially compressed together to provide a heat sealed juncture therebetween.

Figure 7:
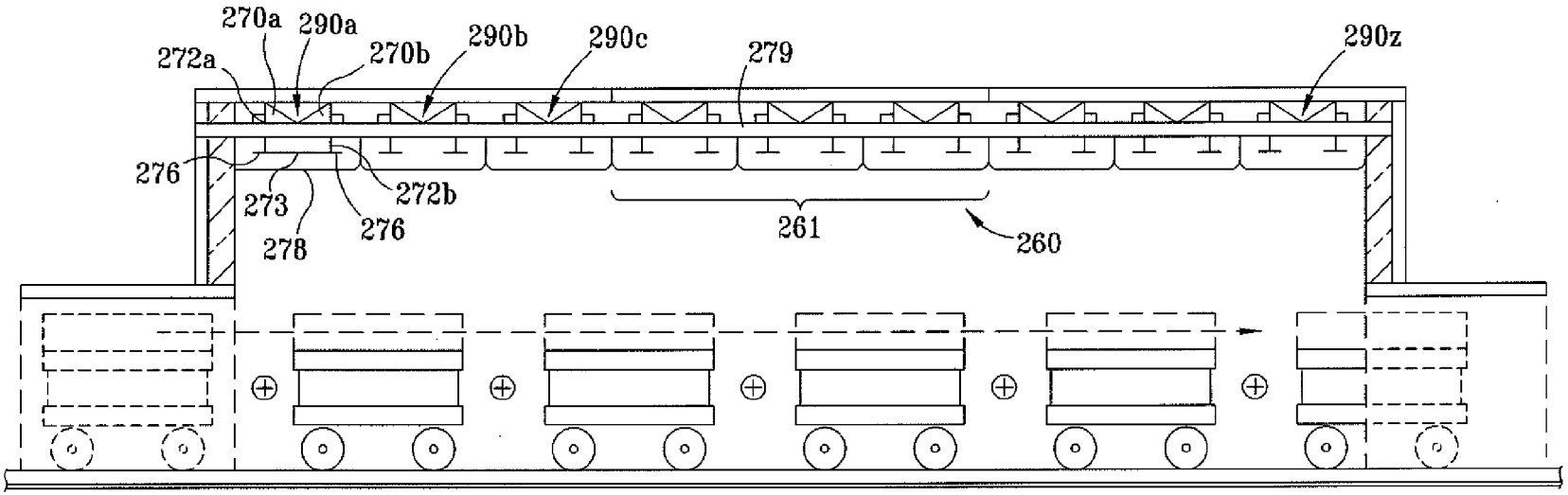
FIG. 7 is a side section view taken along an imaginary center line of an industrial tunnel oven and schematically depicting one alternative embodiment of a replaceable insulation roof construction according to the invention.
Figure 8:
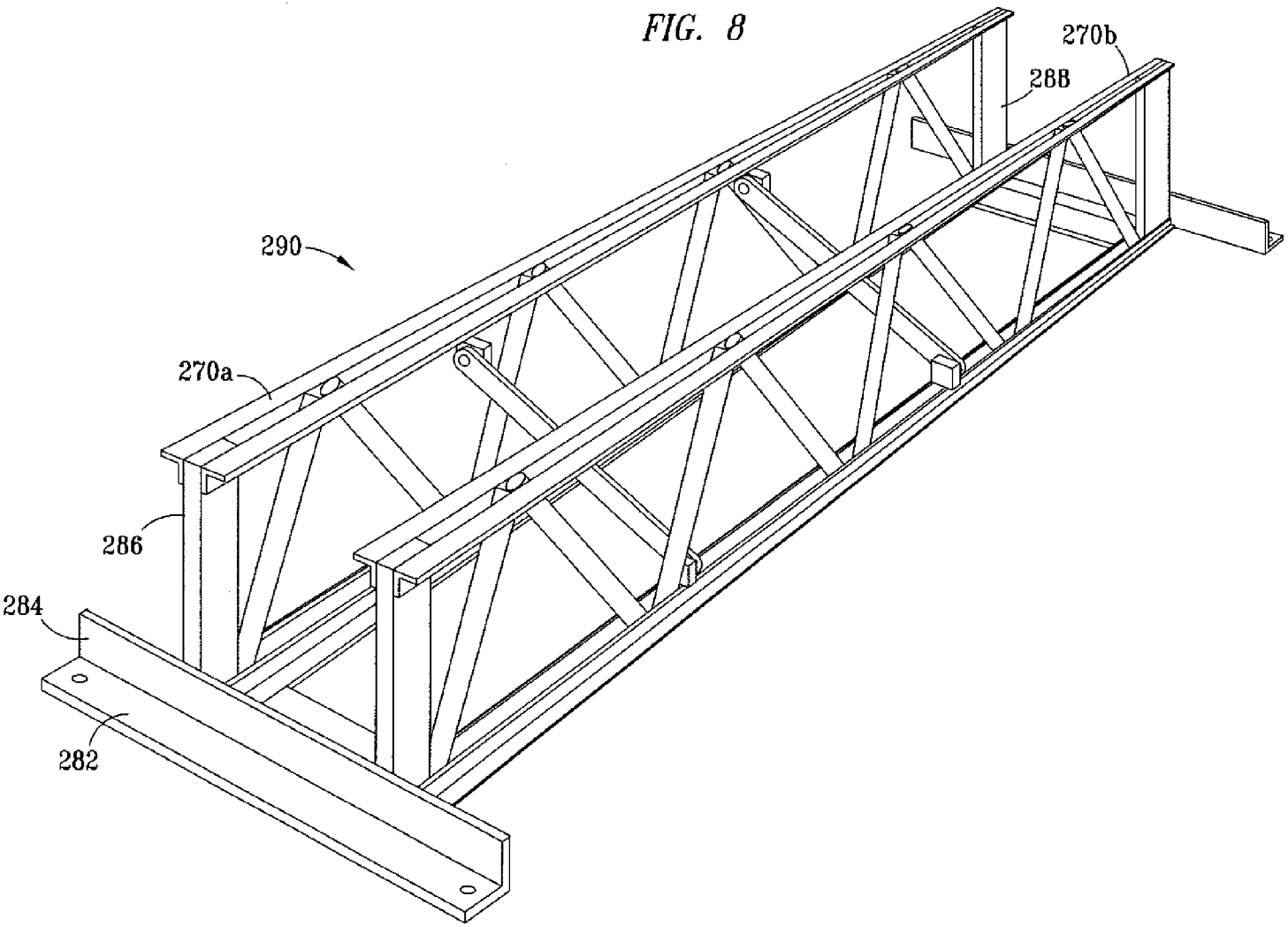
FIG. 8 is perspective view of one embodiment of an alternative truss construction of a replaceable insulation roof according to the invention.

A perspective view of one embodiment of a pair of trusses 270*a* and 270*b* is attached forming a pair of trusses 290 for construction of a replaceable insulation roof 260 according to the invention is depicted in FIGS. 7 and 8. The connected pair of trusses 290 includes vertical bridges 272*a* and 272*b* that may each be constructed as one or more substantially continuous metal plates, may be constructed as a plate with cutout sections, may be constructed as in FIG. 5 with a plurality of beams and cross members fastened together, for example, welded together or bolted together, or may be otherwise formed so that a support structure spans across from one side wall 154 to another side wall 155 of the oven 150. A lower portion 275 (that may include one or more horizontally disposed lips 274 and 276) extends at least partially in a horizontal orientation relative to a vertical support bridge portion 272. The lower portion 275 of the support bridge is securely attached to or is integrally formed along the vertical bridge 272. Fastener plates 282 and 284 may be secured to ends 286 and 288 of the truss 270. Ends 286 and 288 may include a reinforcement structure that is attached to the vertical support bridge 271 to further secure the lower portion 275 to the vertical support bridge 272 and/or to facilitate removably securing the vertical support bridge 272 to the oven walls.

Figure 9:
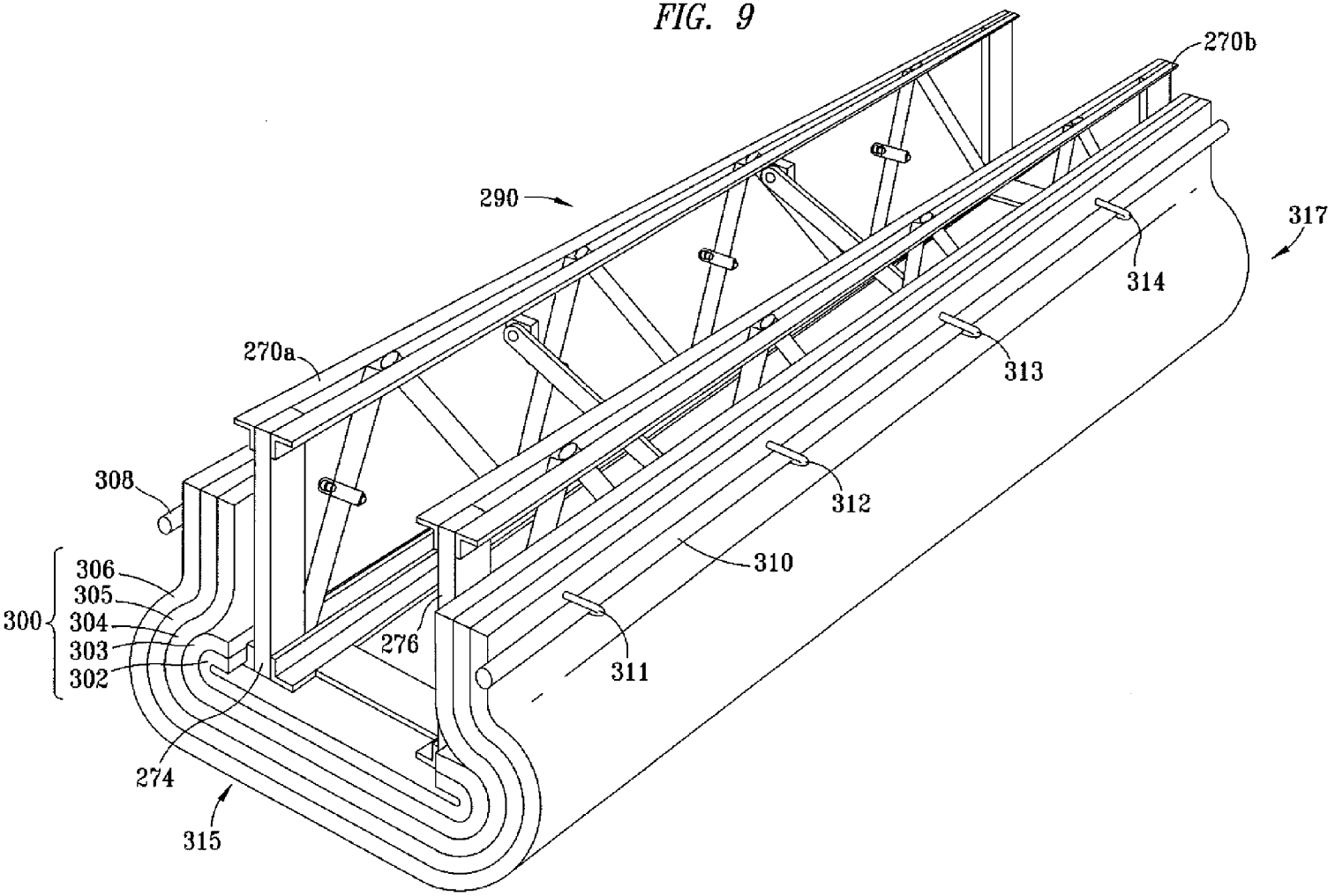
FIG. 9 is a perspective view of an alternative embodiment of a pair of trusses wrapped with insulating material to form a replaceable insulation roof truss according to the invention.

According to one or more embodiments as shown in FIG. 9, fibrous insulating material 278 is wrapped around the lower lips 274 and 276 and may comprise a layered wrapping 300 of the fibrous insulating material comprising a plurality of layers, for example, layers depicted as interior layers 302 and 303, intermediate layers 304 and 305, and exterior layer 306. The layers may be wrapped around each of the lower lips 274 and 276 of trusses 270*a* and 270*b* respectively and upwardly toward the top of truss pair 290 and secured to the vertical bridge members 272*a* and 272*b*. The layers of the fibrous insulating material may be secured to the trusses by clamping or other fastening means that secures the layers upward against the lower lips and tightly together against each other. One example of construction for clamping the insulating layers 300 to the truss 270 includes clamp bar 308 secured to the vertical bridge 272*a* and clamp bar 310 secured to the vertical bridge 272*b* with fasteners such as U-bolts 311-314. The number of layers of fibrous insulation material 278 may be greater or smaller than the number depicted depending upon the intended operation temperatures and cycle times, the thickness of each layer, the heat resistance of the insulation material, and the total minimum thickness of the wrapped insulation material 278, so that the metal truss lips 274, 276 and bridges 272*a* and 272*b* do not become overheated due to heat transfer from the oven passage.

According to one or more useful embodiments, the fibrous insulating material 278 wrapped around the lower lips 274 and 276 may comprise insulating material having varied high temperature characteristics, such as varied maximum temperature rating and varied heat transfer resistance. This can be useful, for example, to reduce cost of insulation material in situations where fibrous insulation material having a higher maximum temperature rating or having higher resistance to heat transfer is typically more expensive than lower temperature rated material or lower heat transfer resistance. The high temperature material (or high heat resistance material) is used at the exterior surface and the lower temperature rated material (or lower heat resistance material) is used at the interior surface against the metal truss lips 274 and 276. A layered wrapping 300 of the fibrous insulating material comprising a plurality of layers, for example, layers depicted as interior layers 302 and 303, intermediate layers 304 and 305, and exterior layer 306. The layers may be wrapped around each of the lower lips 274 and 276 of truss pairs 290 and upward onto the vertical bridge members 272*a* and 272*b*. In one embodiment this usefulness can be obtained by providing high temperature rated material for an exterior layer 306, or at the exterior layer 306 and one or more adjacent intermediate layers 305. For example, fiberglass sheets may withstand temperatures of 450° F. up to about 1000° F., mineral wool and calcium silicate may withstand up to about 1200° F., and ceramic fiber blankets may withstand 2300° F. up to about 3200° F. Typically this rating means that the melting point of the ceramic material is above the rated temperature. In one example embodiment, the exterior layer 306 may be made of ceramic blanket material at the higher end of range up to about 3200° F. The exterior layer may also be selected for enhanced mechanical characteristics such as abrasion resistance. The intermediate layers 305 and/or 304 may be composed of fibrous insulating material rated for temperatures lower than the exposed exterior layer 306, such as an intermediate temperature in a range of below about 3200° F. and above about 2300° F. The mechanical characteristics of the intermediate layers may also be selected to provide durability and structural integrity. The interior layers 303 and/or 302 may be rated at lower temperatures up to about 2300° F. Although an example arrangement is described, it will be understood upon reading this description that other combinations of layers and characteristics may be usefully obtained according to embodiments of the invention based upon the fibrous material layered construction.

According to one or more embodiments, for example, when the insulation on a roof truss is damaged, when an insulated roof truss is to be replaced with different insulation capabilities, or when an insulated roof truss is to be upgraded for higher temperature operation, the existing insulated roof truss can be disconnected from the side walls of the oven, removed from the oven (for example, by lifting with a crane or hoist), and replaced with another insulated roof truss (for example, replaced from above with a crane or hoist). Usefully according to one or more embodiments of the invention, the insulated roof truss may be removed and replaced while the oven continues to operate. While some of the heat from the industrial oven might escape for a short period during the removal and replacement, this can be done with heat shielded equipment, such as cranes or hoists that might be operated quickly and sequentially to minimize the heat loss. Usefully, the industrial oven may continue operation, with the temperature maintained at least in the oven passage that is below other insulated roof trusses that are not being removed and replaced. Thus, the entire oven need not be shut down and cooled to allow entry into the oven for repair, replacement, or upgrading. In some instances the burners in the oven below the insulated roof truss to be replaced and/or below adjacent insulated roof trusses of the oven roof can be temporarily adjusted to reduce the heat loss during roof section lifting and/or to compensate for the heat loss during removal and quickly when the replacement roof section is installed.

Figure 10:
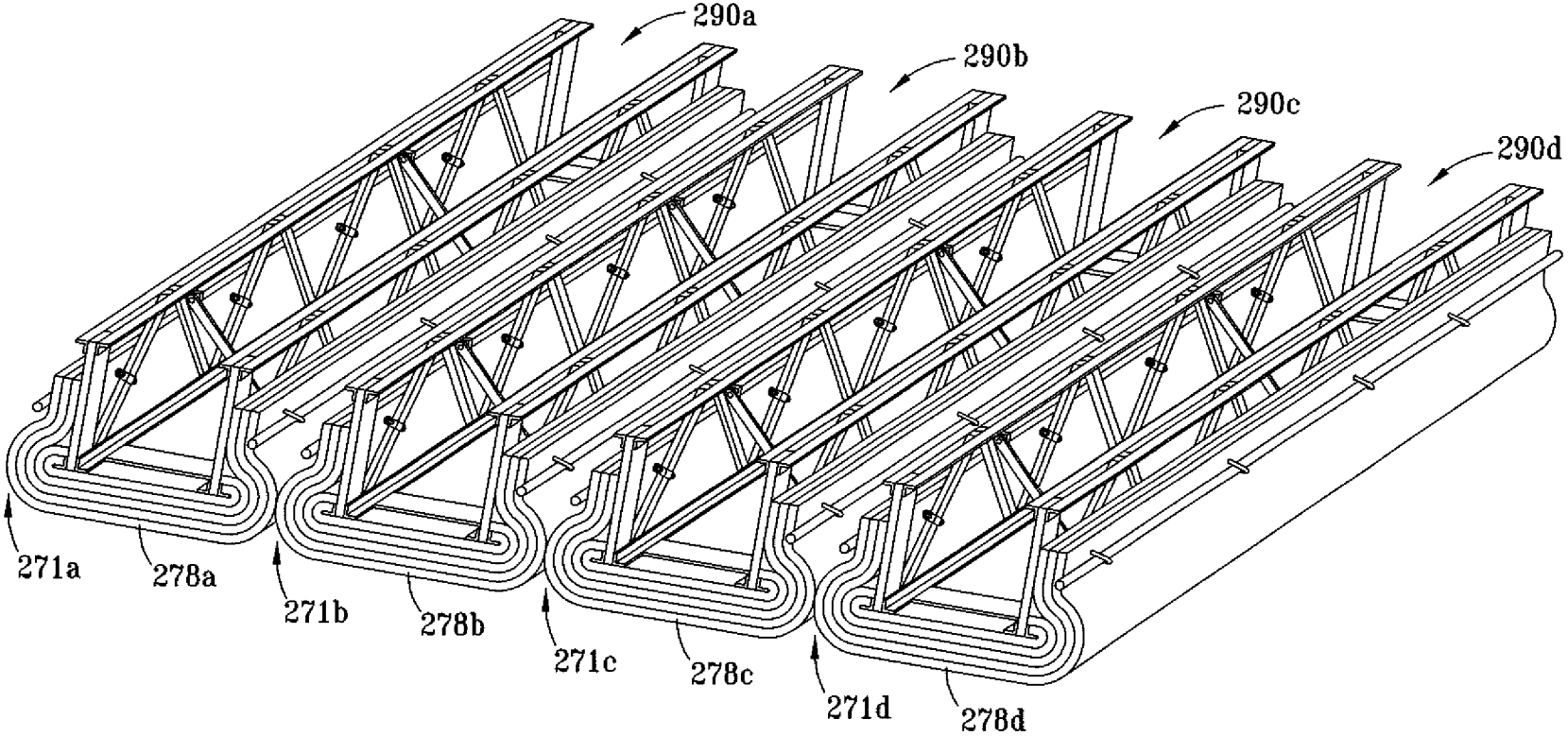
FIG. 10 is a perspective view of a section of a plurality of replaceable insulation roof trusses positioned together to form an insulated roof for an industrial oven according to one embodiment of the invention.
Figure 11:
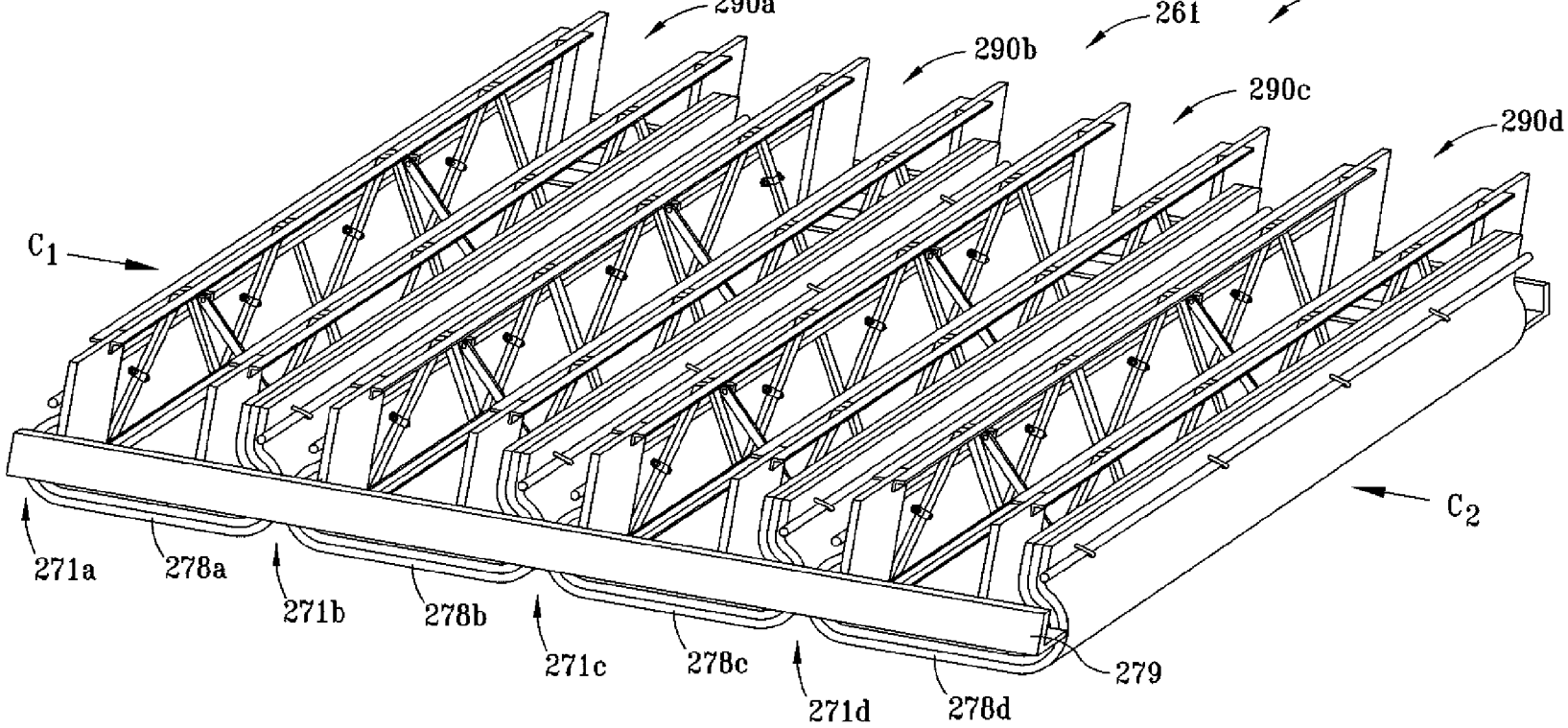
FIG. 11 is a perspective view of a plurality of replaceable insulation roof trusses attached together in a replaceable insulated roof section for an industrial oven according to one embodiment of the invention.

In one or more embodiments, as may be understood with reference to FIGS. 10 and 11, more than one insulated connected pair 290 of insulated roof trusses (for example, insulated connected truss pairs 290*a*, 290*b*, 290*c*, and 290*d*) may be structurally attached together at 279 to form an insulated roof section 261, as in FIG. 10. According to one embodiment the insulated pairs of trusses are pressed together tightly along the length of the oven so that the exterior surface of fibrous insulation material 306*a* compresses tightly against the end wall of the oven to form a heat seal interface at 271*a*. The exterior surface 278*a* of fibrous material 306*a* of the insulated truss pair 290*a* is also compressed tightly together against the exterior surface 278*b* of fibrous insulation material 306*b* of the next adjacent pair of trusses 290*b* to form a heat seal interface at 271*b* and each adjacent exterior surface is pressed tightly against each adjacent exterior surface to compress each exterior layer of material 306 of each adjacent truss to form heat sealed interfaces 271*c*, 271*d*, etc. The sides 315 and 316 of the fibrous insulation layers may extend sufficiently beyond the metal truss structure wider than the inside of the spaced apart interior walls of the oven so that the fibrous insulation material compresses against the walls to form heat sealed interfaces.

In another embodiment, the truss pairs 290*a*, 290*b* and 290*c* may be attached together in a section 261 as shown in FIG. 11. In such an embodiment a sufficient thickness of fibrous materials are provided so that the insulation material is compressed together, as for example by applying opposed compressive forces C1 and C2 to force the truss pairs 290*a*, 290*b* and 290*c* against each other when the truss pairs 290*a*, 290*b* and 290*c* are secured together in a replaceable insulted roof section 261. The interface surfaces 271*b*, 271*c*, and 271*d* of the insulation material 278 compresses (see FIG. 11) to form a heat seal therebetween. The width of a given construction of insulated truss pairs 290 or replaceable insulated roof sections 261 may be different from one oven to another depending upon the width of the oven or from one part of the oven to another depending upon the width of the oven at a particular location. A plurality of replaceable insulated roof sections 261 may be formed to cover the entire length of the oven. The spacing of each of the truss pairs 290 or of each section 261 is such that compression of the fibrous material between the pairs and sections forms a heat seal. Any one or more of the insulated roof sections 261 may be removed and replaced while the oven is operating, without replacing the entire roof 260. Thus, the portion of the industrial oven roof 260 that is open during removal or replacement is limited to the removed section and the oven may continue to operate with only small interference with the heating operation within the oven.

Figure 12:
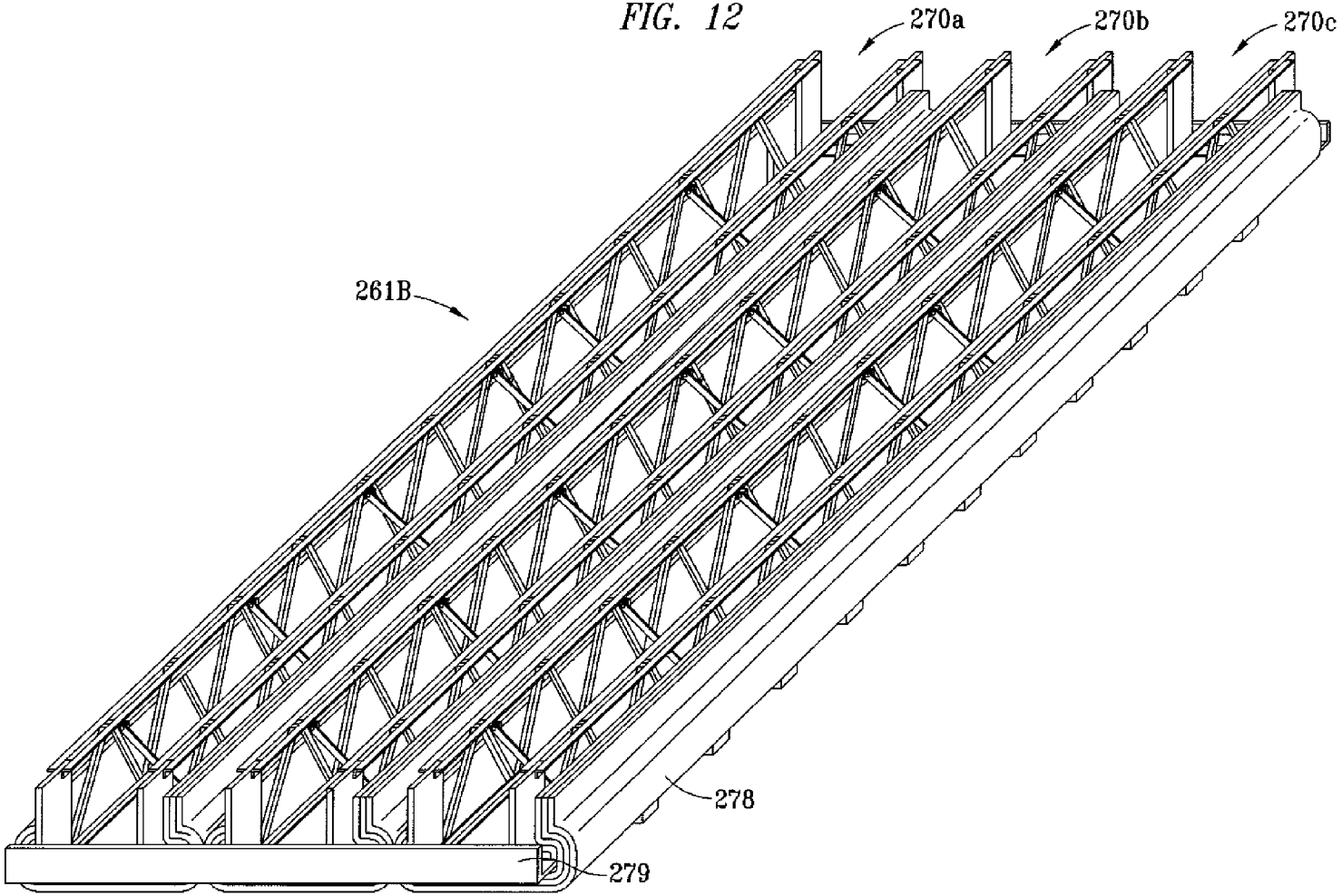
FIG. 12 is a perspective view of an alternative construction of a section of a replaceable insulation roof for an industrial oven according to one embodiment of the invention.

In one or more embodiments, as may be understood with reference to FIGS. 11 and 12, selected numbers of pairs of insulation wrapped trusses may be attached together to form an insulated roof section. For example, in FIG. 11 a replaceable insulated roof section 261A is depicted with four (4) pairs of trusses 290 and in FIG. 12 a replaceable insulated roof section 261B is depicted with three (3) pairs of trusses 290. In the embodiment of replaceable section 261A shown in FIG. 11 the side to side dimension is shorter than in the other embodiment of replaceable insulated roof section 261B shown in FIG. 12. In either embodiment shown, or in other embodiments as may be understood from this disclosure, a plurality of the insulated roof sections 261 may be replaceably attached across the tops of side walls of the oven with heat seals formed therebetween, and the dimensions will appropriate according to the oven dimensions. In one or more alternative embodiments, a section 261 of pairs of insulation wrapped trusses 290 may be removed and replaced, without removing and replacing other replaceable insulated roof sections 261 of insulated truss pairs 290, so that the portion of the oven roof 260 that is open during removal or replacement of one of the replaceable insulated roof sections 261 is limited to the area of the replaceable insulated roof section 261. The industrial oven may continue to operate with only minor interference with the heating operation within the industrial oven.

Figure 13:
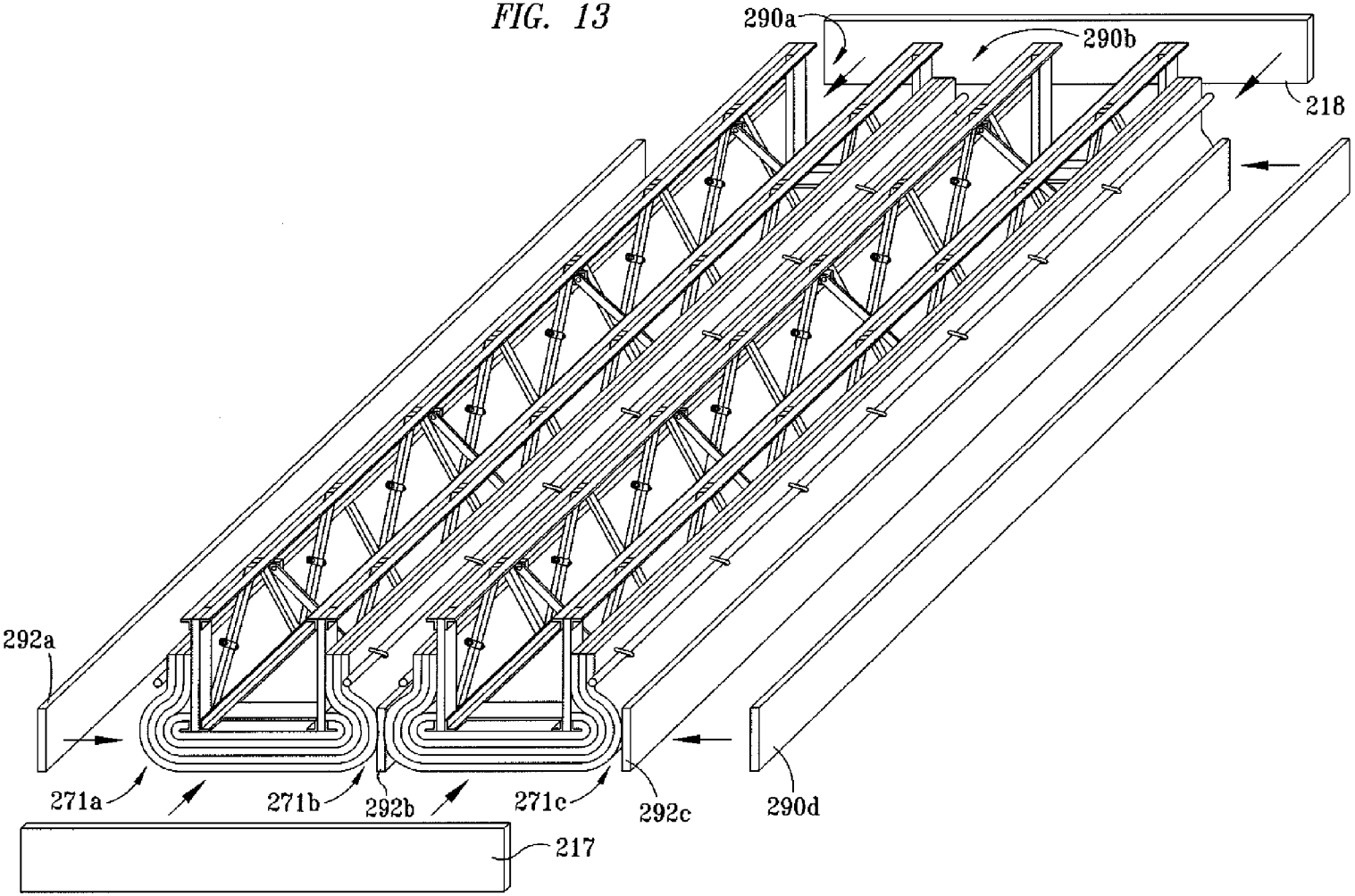
FIG. 13 is a perspective view of an alternative construction of a section of a replaceable insulation roof for an industrial oven according to one embodiment of the invention.

According to one or more embodiments of the invention an alternative construction of a replaceable insulated roof section 261C of a replaceable insulation roof for an industrial oven is shown in FIG. 13. In the embodiment the interface heat seals between insulated truss pairs 290*a* and 290*b* and between truss pairs and the oven walls are beneficially enhanced by insertion of added sheets of insulation material, for example, added sealing insulation sheets 292*a*, 292*b*, 292*c*, and 292*d* between the insulation material surfaces 278*a*, 278*b* and 278*c* at which a heat seal is to be formed either between one truss pair and another truss pair or between a truss pair and an end wall of an industrial oven. This can effectively increase the compression of the insulation materials to facilitate forming a heat seal. Also, it has been found by the inventors that this method of adding one or more added insulating sheets of insulating material, see example 292*c* and 292*d*, can be used during replacement to fill in gaps that might arise due to loss or damage of vitrified portions of the insulation layers upon removal of the damaged trusses, truss pairs, or replaceable sections. Similarly, added side sealing sheets 217 and 218 of insulation material may be added between the sides 215 and 216 of the replaceable trusses, replaceable truss pairs, or replaceable sections and the side walls of the oven to further provide a compressed insulation material seal.

According to one or more embodiments, a method of insulation and repair is provided by constructing a roof of a tunnel oven according to the invention described in the preceding paragraph. In the event that any of the insulating materials become damaged, one or more of the structural insulating units may be removed and replaced. In the event that a truss is damaged or in the event the insulating material wrapped around the lip of a truss is damaged, adjacent sections of the insulating units may be removed on either side of the damaged truss. The entire damaged truss can be removed and replaced. The repair may be conducted quickly with protective heat gear for equipment and repair personnel. The industrial oven may continue to operate with only minor possible temperature fluctuations or partial temporary interruption at the point of repair, without shutting down the entire industrial oven.

The plurality of insulated trusses are pressed together side by side between the side walls of the oven and supported by the adjacent insulated truss lips so that a gas impervious insulating roof section is formed across the width of the tunnel oven, multiple spaced apart trusses are used to form multiple adjacent gas impervious insulating roof sections and the adjacent roof sections extend end to end along the length of the tunnel oven thereby providing a substantially continuous insulating roof.

According to one or more embodiments, a method is disclosed for providing an insulated roof for an industrial tunnel oven having parallel side walls along the length of the tunnel oven and spaced apart by the tunnel oven width. The method comprises forming a plurality of support trusses extending across the width and supported at the top of the tunnel oven from one side wall to the other side wall. At least one lower lip is formed extending from each truss in a direction parallel to the length of the oven. The lower lip is wrapped with ceramic fiber insulating blanket material. A plurality of replaceable adjacent trusses are abutted together to form a substantially gas impervious insulating roof.

According to one or more embodiments, a method of insulation and repair is provided by constructing a roof of a tunnel oven according to the invention described in the preceding paragraph. In the event that any of the insulating materials become damaged, one or more of the structural insulating units may be removed and replaced. In the event that a truss is damaged or in the event the insulating material wrapped around the lip of a truss is damaged, adjacent sections of the insulating units may be removed on either side of the damaged truss. The entire damaged truss can be removed and replaced. The insulating units may be replaced in the sections adjacent to the replaced truss. The repair may be conducted quickly with protective heat gear for equipment and repair personnel. The industrial oven may continue to operate with only minor possible temperature fluctuations or partial temporary interruption at the point of repair, without shutting down the entire industrial oven.

According to one or more embodiments, a method is disclosed for providing an insulated roof for an industrial tunnel oven having parallel side walls along the length of the tunnel oven and spaced apart by the tunnel oven width. The method comprises forming a plurality of support trusses extending across the width and supported at the top of the tunnel oven from one side wall to the other side wall. At least one lower lip is formed extending from each truss in a direction parallel to the length of the oven. The lower lips of the connected pair of trusses are wrapped with ceramic fiber insulating blanket material. The replaceable insulated connected pairs of trusses are abutted together to form a substantially gas impervious insulating roof.

While the invention has been described with respect to a limited number of embodiments, and the discussion has focused on a limited number of embodiments of an insulated roof, apparatus and method, those skilled in the art, having benefit of this disclosure, will appreciate that other embodiments, arrangements and combinations of inventive features can be devised according to the disclosure that do not depart from the scope of the invention as disclosed herein. Accordingly, the scope of the invention should be limited only by the broadest interpretation of the attached claims.

What is claimed is:

1. An insulated roof for an industrial oven of the type having a heated length of a passage between insulated side walls spaced apart by a width of the heated passage, the insulated roof comprising:

a plurality of insulated connected pairs of roof trusses extending across the width of the passage of the industrial oven from one side wall to another side wall, each insulated connected pair of roof trusses comprising two vertical metal bridges having lower portions connected to each other and having fibrous insulating material wrapped around the lower portions of the two vertical metal bridges and extending between the lower portions of each of the two metal bridges to form continuous insulation therebetween;

wherein, each of the plurality of insulated connected pairs of roof trusses are positioned adjacent and parallel to each other along a predetermined portion of the length of the heated passage of the industrial oven;

a heat resistant seal formed between the adjacent insulated connected pairs of roof trusses so that a substantially continuous insulated roof is formed along the predetermined portion of the length of the oven passage; and wherein the insulated connected pairs of roof trusses are removably attached to the side walls of the industrial oven so that one or more of the plurality of insulated connected pairs of roof trusses may be removed and replaced without removing and replacing all of the insulated connected pairs of roof trusses.

2. The insulated roof of claim 1, wherein heat resistant seal comprises the fibrous insulating material of one insulated connected pair of roof trusses in partially compressed contact against the fibrous insulating material of an adjacent insulated connected pair of roof trusses to form partially compressed fibrous insulating material therebetween.

3. The insulated roof of claim 1, wherein heat resistant seal comprises at least one added layer of fibrous insulating material interposed and in partially compressed contact between the fibrous insulating material of one insulated connected pair of roof trusses and the fibrous insulating material of an adjacent insulated connected pair of roof trusses to form partially compressed fibrous insulating material therebetween.

4. The insulated roof of claim 1, comprising:

a plurality of removable insulated roof sections formed of two or more of the insulated connected pairs of roof trusses extending across the width of the passage of the industrial oven from one side wall to another side wall, the plurality of sections positioned end-to-end along a predetermined length of the oven, wherein the two or more connected pairs of roof trusses are attached together in each of the plurality of removable insulated roof sections; and a heat seal formed between the fibrous insulating material wrapped around one insulated connected pair of roof trusses at one of the ends of one removable insulated roof section and the fibrous insulating material wrapped around another insulated connected pair of roof trusses at another of the end of an adjacent removable insulated roof section thereby forming a substantially continuous insulated roof along the predetermined portion of the length of the heated passage of the industrial oven and each removable insulated roof section can be removed from the walls of the industrial oven and replaced while the insulated connected pairs of trusses remain attached together as a section.

5. The insulated roof of claim 4, wherein the heat seal comprises the fibrous insulating material of one insulated connected pair of roof trusses of a replaceable insulated roof section in partially compressed contact against the fibrous insulating material of an adjacent insulated connected pair of roof trusses of an adjacent replaceable insulated roof section to form the heat seal of partially compressed fibrous insulating material therebetween.

6. The insulated roof of claim 4, wherein heat seal comprises at least one added layer of fibrous insulating material interposed and in partially compressed contact between the fibrous insulating material of one insulated connected pair of roof trusses of a replaceable insulated roof section and the fibrous insulating material of an adjacent insulated connected pair of roof trusses of a replaceable insulated roof section to form the heat seal of partially compressed fibrous insulating material therebetween.

7. The insulated roof of claim 1, wherein the fibrous insulating material comprises blankets of ceramic fiber.

8. The insulated roof of claim 7, wherein the fibrous insulating material comprises a plurality of wrapped layers of fibrous insulation material, wherein the heat characteristics of at least one of the plurality of wrapped layers is different from the heat characteristics of at least one other layer of the plurality of wrapped layers of fibrous insulation material.

* * * * *